United States Patent [19]

Thomas

[11] Patent Number: 4,896,622

[45] Date of Patent: Jan. 30, 1990

[54] ATTITUDE CONTROL APPARATUS FOR SPEEDBOATS

[76] Inventor: William E. Thomas, 7184 Teak Way, Alta Loma, Calif. 91701

[21] Appl. No.: 323,678

[22] Filed: Mar. 15, 1989

[51] Int. Cl.[4] ..... B63B 1/22

[52] U.S. Cl. ..... 114/285; 114/271

[58] Field of Search ..... 114/271, 273, 284–287, 114/145 A

[56] References Cited

U.S. PATENT DOCUMENTS 2,332,178 10/1943 Smith ..... 114/285

3,628,484 12/1971 Banner ..... 114/285

*Primary Examiner*—Joseph F. Peters, Jr.

*Assistant Examiner*—Edwin L. Swinehart

*Attorney, Agent, or Firm*—John H. Crowe

[57] ABSTRACT

A mechanism with one foot pedal for controlling the fore-and-aft attitude of a high-speed boat having the usual cavitation or trim plate. When the foot pedal is depressed the cavitation plate is lowered through an interconnecting assembly of pivoted members to lower the bow of the boat against any upending tendency as it accelerates from a dead stop in the water. As the boat speed increases, release of pressure on the foot pedal causes movement of the cavitation plate to an upper position, wherein it is ineffective to lower the bow, and locking of the plate in that position until the foot pedal is again depressed.

10 Claims, 2 Drawing Sheets

5
12
22
23
24
26
27
28
30
31
32
33
34
35
36
37
38
40
41
42
43
44
45
46
47
48
50
51
52
53
54
56
58
61
62
63
64
65
66
67

12
22
23
24
26
27
28
30
31
32
33
34
35
36
37
38
40
41
42
43
44
45
46
47
48
50
51
52
53
54
56
58
61
62
63
67

ATTITUDE CONTROL APPARATUS FOR SPEEDBOATS

BACKGROUND OF THE INVENTION

1. Field of the Invention

This invention relates to apparatus for maintaining the hull of a high-powered speedboat in a proper fore-and-aft attitude, particularly when accelerating, to prevent pitching or upending.

2. Description of the Prior Art

In an engine-powered boat, the propellor is generally located below the hull and near the stern. Thus, in high-powered boats, such as are used for racing, the forces exerted by the propellor, especially during acceleration, tend to cause the boat to upend, i.e., for the bow to rise sharply. In drag racing, where the race commences from a dead start, this problem is acute and hazardous.

To overcome the above problem, drag racing boats, as well as ski towing boats and the like, are usually fitted with a cavitation or trimming plate unit which is mounted at the stern for an up-down swinging adjustment under control of the boat driver. As the boat accelerates from a starting position, the driver forces the cavitation plate downwardly to react against the water to resist any upending tendency.

Control of the plate is critical, since if it is overly depressed at high speeds it could cause the bow to dig into the water and if it is under-depressed, the bow could rise excessively. As the speed increases, the plate must be allowed to rise to maintain the hull in a planing attitude. Thus, it will be seen that the driver's judgement is critical and he must react fast and precisely to attain the highest speed in the shortest time period.

In the case of flat-bottom speedboats, the ideal condition for highest speed is one in which the boat is substantially airborne slightly above the water with a layer of air trapped under the hull to support much of its weight. The remainder of the weight is supported at the stern by the cavitation plate which rides on the surface of the water.

Heretofore, control of the cavitation plate was generally accomplished by providing two foot pedals to be manipulated by the driver. Pressure on one pedal against the force of an actuator spring causes downward movement of the plate, and as the boat accelerates, foot pressure is released allowing the spring and the forward movement of the boat to raise the plate to an upper position where it itends to maintain the boat in a planing position. However, since different forces, such as acceleration, wave action, wind, etc., act on the boat, tending at times to move the plate out of this upper position and allow pitching, the second foot pedal is provided to enable manual positioning of the plate against the action of these forces, Since the driver has to use one foot to control the engine throttle, he has to use his remaining foot to quickly shift from one foot pedal to the other and to apply appropriate pressure at the right time. This requires utmost concentration and attention by the driver at a time when other functions and controls must also be attended to.

SUMMARY OF THE INVENTION

A principal object of the present invention is to overcome the above-noted problems.

Another object is to effect control of the cavitation plate of a speedboat by use of a single foot pedal.

Another object is to provide a simple and effective way of locking the cavitation plate in a predetermined setting and for releasing the plate by means of a single foot pedal.

I have discovered that far better control of the cavitation plate can be accomplished with less concentration and physical exertion by the driver through the use of a single foot pedal and simple linkage controlled thereby which, when the pedal is depressed, moves the plate to a lower position, and when released, provides a self locking function capable of locking the plate in a raised position and unlocking the same when the pedal is later depressed.

BRIEF DESCRIPTION OF THE DRAWING

The manner in which the above and other objects of the invention are accomplished will be readily apparent from the accompanying drawing, considered in conjunction with the following specification, wherein.

DESCRIPTION OF THE PREFERRED EMBODIMENT

Figure 1:
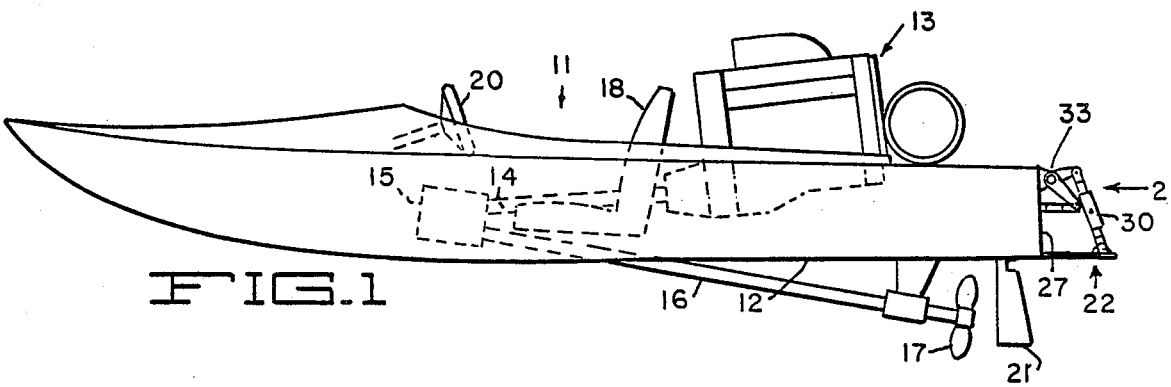
FIG. 1 is a side view of a typical flat-bottom speedboat embodying a preferred form of the present invention.

Referring to the drawing, FIG. 1 illustrates a typical racing speedboat generally indicated at 11 which may be used for drag racing, water-ski towing and the like. The boat has a flat bottom 12 and is powered by an engine 13 whose drive shaft 14 is connected through a V-type transmission 15 to a propellor shaft 16 carrying a propellor 17. A seat 18 is provided for the boat driver and a steering wheel 20 is provided for controlling a rudder 21.

A cavitation plate unit generally indicated at 22 is mounted at the stern of the boat and preferably comprises three sections, including a central plate section 23 (FIG. 2) and two outboard plate sections 24 and 25. The plate sections are flexible and each is attached at its forward end to the bottom 12 of the boat hull by bolts 26 (FIG. 3 and 4) and extends rearwardly of the transom 27. The plate sections are pivotally connected at 28 to adjustable turnbuckle links 30 which, in turn, are pvited at 31 to respective arms 32 suitably fastened to a shaft 33 journaled in bearings 34 secured to the transom 27. The shaft 33 s also attached to and rocked by an arm 35 pivoted at 36 to a tie rod unit 37 which, in turn, is pivotally connected at 38 to an idler lever 40.

It will be noted that the tie rod unit 37 is adjustable in length, and for this purpose, it comprises a tie rod 41 screw-threaded in opposite directions at opposite ends in end members 42 and 43 which carry the pivotal connections 36 and 38, respectively.

The idler lever 40 is fulcrumed on a pivot rod 44 which is attached to a bearing block 45 suitably secured to a stringer 46 forming a part of the boat hull structure.

The idler lever 40 is also pivotally connected at 47 to a link 48 which is pivoted at 50 to an arm 51 suitably attached to a pedal shaft 52. The latter is rockably mounted in bearings formed in the block 45 and stringer 46 and terminates in a foot operated pedal 53.

Figure 5:
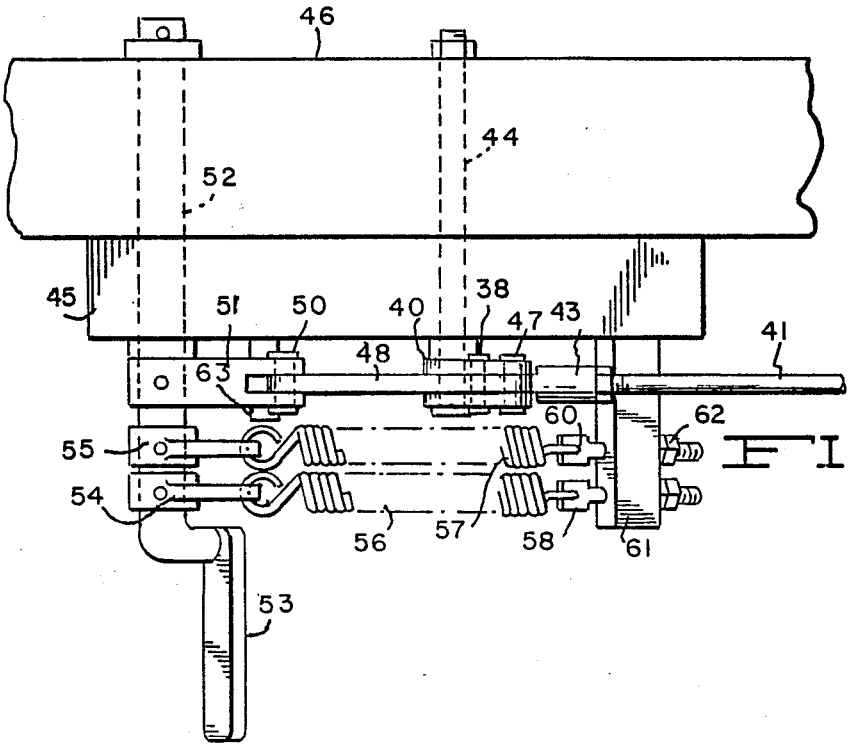
FIG. 5 is a plan view taken in the direction of the arrow 5 in FIG. 3.

Also attached to the pedal shaft 52 are a pair of arms 54 and 55 (FIG. 5) which are connected to the ends of relatively stiff tension springs 56 and 57 which are connected at their opposite ends to anchor bolts 58 and 60, respectively. The latter pass through and are supported by an anchor bracket 61 suitably secured to the bearing block 45. Lock nuts 62 are threaded on the bolts 58 and 60 and are adjustable therealong to vary the tension applied to the springs 56 and 57.

Figure 3:
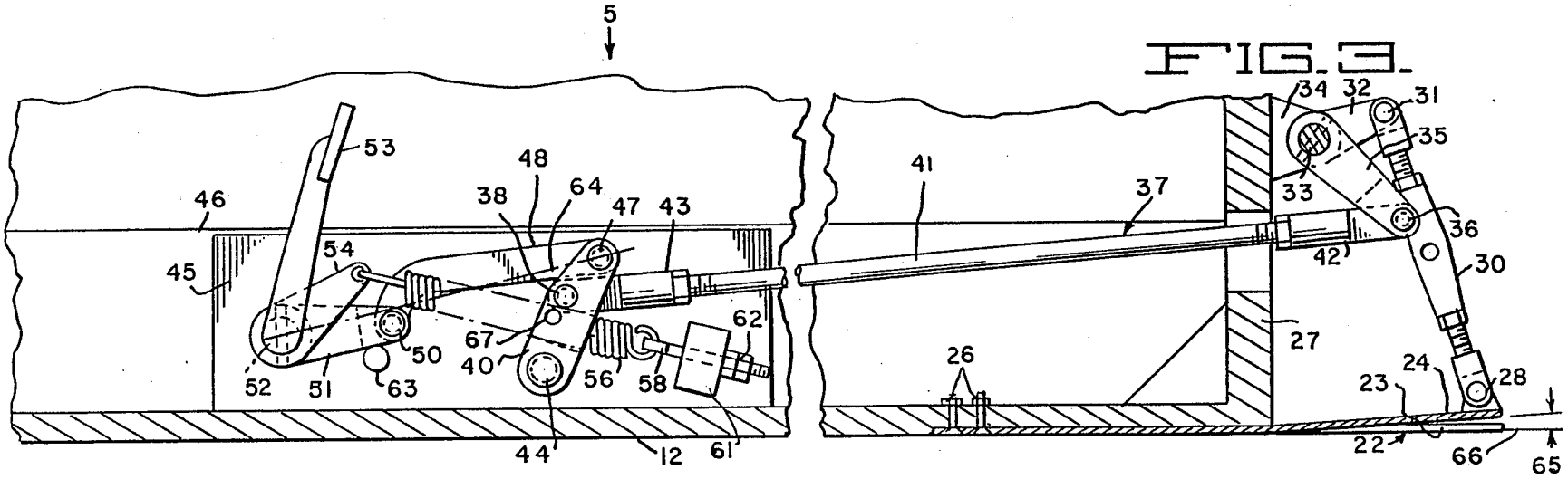
FIG. 3 is a longitudinal sectional view showing the control linkage of the invention and taken along line 3—3 of FIG. 2, the control linkage being shown with the cavitation plate in its upper, locked condition.

Normally, the springs 56 and 57 hold the parts of the aforesaid linkage in their positions shown in FIG. 3 wherein the arm 51 limits against a stop pin 63 fastened to the block 45. In such position of the linkage, the center of the pivot 50 is located below a plane 64 passing through the centers of the pedal shaft 52 and the pivot 47. Thus, the cavitation plate unit is locked in its upper position of FIG. 3 wherein the center plate section 23 extends typically at an angle 65 of approximately 1½ degrees above the plane 66 of the hull bottom surface 12.

Figure 4:
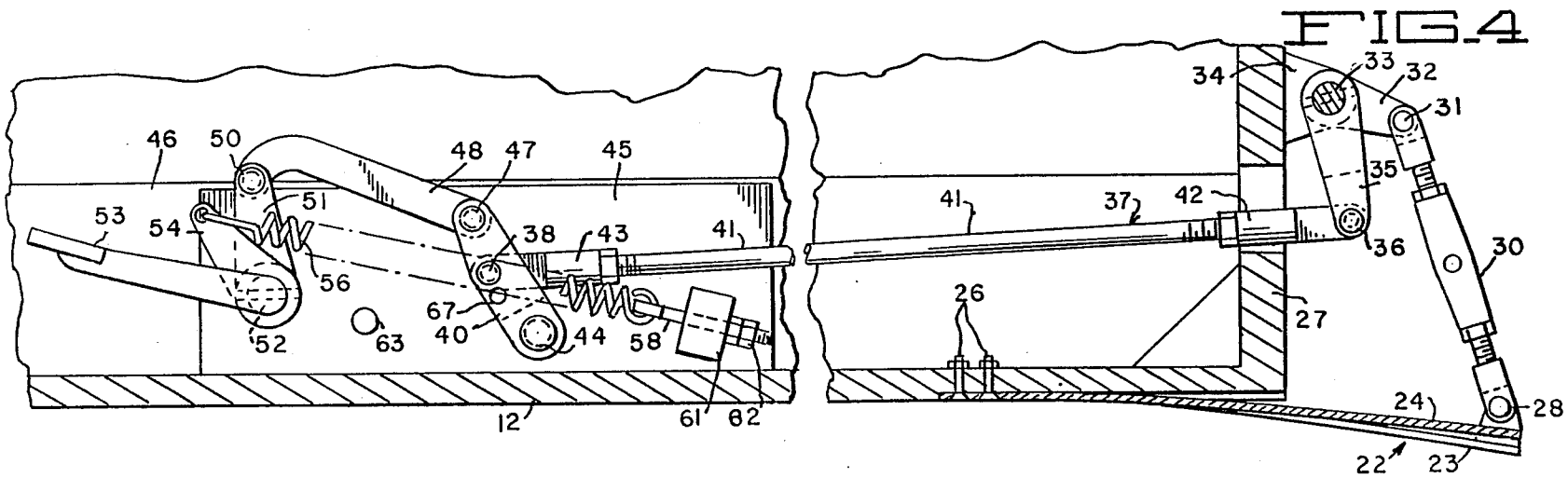
FIG. 4 is a sectional view similar to that of FIG. 3 but showing the control pedal depressed to hold the cavitation plate depressed.

In accelerating from a stationary position, the driver presses the pedal 53 counterclockwise into substantially the position shown in FIG. 4 against the action of the springs 56 and 57 to depress or flex the plate unit into its lower position wherein it typically extends about 8½ degrees below the plane 66. Thus, as the boat accelerates, the plate unit 22 will react against the water and counteract any upending tendency due to the force exerted by the propellor.

As a boat increases in speed and assumes a planing attitude slightly above the surface of the water, the driver allows the springs and the forward movement of the boat to return the pedal and plate unit 22 to their positions of FIG. 3 wherein they are locked by the aforesaid over center relationship of the arm 51 and link 48, thus preventing the plate unit from being inadvertently moved out of its upper position. At this time, the boat will be substantially airborne with a layer of air formed under the hull bottom 12 and the plate unit 22 maintaining the boat in planing condition.

Figure 2:
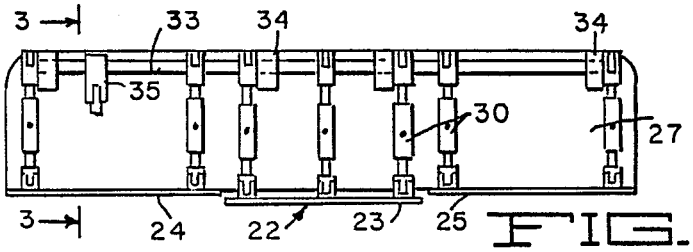
FIG. 2 is a rear view of the boat taken in the direction of the arrow 2 in FIG. 1.

As seen in FIG. 2, the center cavitation plate section 23 is preferably adjusted so that it is located a slight distance below the planes of the outer plate sections 24 and 25. Thus, as the boat assumes its planing attitude, the plate section 23 will ride on the surface of the water and the outer plate sections will therefore not appreciably contribute a lifting force to the boat but will reduce any tendency for the boat to roll.

It will be noted that the lever arm existing between the pivot rod 44 and the pivot connection 47 of lever 40 is greater than the lever arm existing between the rod 44 and the pivot connection 38. This will reduce the force required by the driver to move the plate unit 22 against the action of the springs. Also, the pivot connection 38, which may comprise a suitable pivot pin, may be selectively moved to pivot in a bearing hole 67 in the lever 40 to thus change the extent of movement of the plate between its upper and lower positions.

Although the plate unit is shown as comprising three independently adjustable plate sections, it could, if desired, be formed of a single plate.

From the foregoing, it will be seen that the present invention provides a simple and reliable mechanism for enabling a speedboat driver to properly control a cavitation plate unit by means of a single control pedal and to lock the plate unit against forces tending to move it out of controlling position at high speeds. This is of considerable importance, especially in high-speed boats used for drag racing and the like where speeds in the neighborhood of 150 miles per hour are attained and the driver must react to different driving conditions with the utmost speed.

I claim:

1. Apparatus for controlling the fore-and-aft attitude of a speedboat having a cavitation plate mounted thereon for swinging movement relative to the bottom of said boat, comprising:

a manually operable first control device;

first pivot means pivotally supporting said first control device;

control mechanism including a second control device for swinging said cavitation plate between an upper position and a lower position;

second pivot means pivotally supporting said second control device;

a link;

a first pivot connection between said link and said first control device;

a second pivot connection between said link and said second control device;

spring means urging said first control device to hold said cavitation plate in said upper position and to maintain said first pivot connection on one side of a plane passing through said first pivot means and said second pivot connection; and said first control device being manually movable to move said first pivot connection to the opposite side of said plane and said cavitation plate to said lower position.

2. Apparatus as defined in claim 1 comprising means for preventing free movement of said first pivot connection from said one side of said plane whereby to lock said cavitation plate in said upper position.

3. Apparatus as defined in claim 2 including means for adjusting said control mechanism to change said lower position of said cavitation plate.

4. Apparatus as defined in claim 2 including means for adjusting said control mechanism to change said upper position of said cavitation plate.

5. Apparatus as defined in claim 1 wherein said second control device comprises a lever;

said control mechanism includes a connector element; and said apparatus includes a third pivot connection pivotally connecting said connector element to said lever to form a lever arm different from the lever arm between said second pivot means and said second pivot connection.

6. Apparatus as defined in claim 5 wherein the length of the first-mentioned lever arm is less than that of the last-mentioned lever arm.

7. Apparatus as defined in claim 5 including means for varying the length of said connector element.

8. Apparatus as defined in claim 1 wherein said manually operable device comprises a foot pedal for moving said first pivot connection to said opposite side of said plane.

9. Apparatus for controlling the fore-and-aft attitude of a speedboat having a cavitation plate mounted thereon for swinging movement relative to the bottom of said boat, comprising:

a manually operable control device;

first pivot means pivotally supporting said control device;

means for guiding said control device through an operating path from a first position toward a second position;

control mechanism including a control element for swinging said cavitation plate up and down;

second pivot means pivotally supporting said control element;

a link;

a first pivot connection between said link and said control device;

a second pivot connection between said link and said control element;

spring means urging said control device toward said first position to hold said first pivot connection on one side of a plane passing through said first pivot means and said second pivot connection and to cause said control mechanism to maintain said cavitation plate in an upper position; and means for limiting movement of said first pivot connection on said one side of said plane whereby to lock said cavitation plate in said upper position.

said control device being manually movable toward said second position to move said first pivot connection to the opposite side of said plane and to cause said control mechanism to swing said cavitation plate to a lower position.

10. Apparatus as defined in calim 9 wherein said manually operable control device comprises a foot pedal.

* * * * *